United States Patent [19]

Hori

[11] Patent Number: 4,715,277

[45] Date of Patent: Dec. 29, 1987

[54] TYPE SELECTION MECHANISM FOR A PRINTER

[75] Inventor: Fumihisa Hori, Takizawa, Japan

[73] Assignee: Alps Electric Co., Ltd., Japan

[21] Appl. No.: 937,348

[22] Filed: Dec. 3, 1986

[30] Foreign Application Priority Data

| | | | |
|---|---|---|---|
| Dec. 25, 1985 | [JP] | Japan | 60-198212[U] |
| Dec. 27, 1985 | [JP] | Japan | 60-293089 |
| Feb. 7, 1986 | [JP] | Japan | 61-24100 |
| Feb. 7, 1986 | [JP] | Japan | 61-24101 |
| Feb. 17, 1986 | [JP] | Japan | 61-30660 |

[51] Int. Cl.[4] ..... B41J 1/48

[52] U.S. Cl. ..... 101/93.28; 101/93.21; 101/93.48

[58] Field of Search ..... 101/93.28, 93.29, 93.3, 101/93.35, 93.21

[56] References Cited

FOREIGN PATENT DOCUMENTS

| | | | |
|---|---|---|---|
| 21798 | 5/1980 | Japan | 101/93.21 |
| 77176 | 6/1981 | Japan | 101/93.21 |

*Primary Examiner*—Clifford D. Crowder

*Attorney, Agent, or Firm*—Guy W. Shoup

[57] ABSTRACT

A printer includes a drive claw associated with a printing wheel and having a projection engageable with axial, circumferential grooves of a drive shaft. The printing wheel is linked to and rotated by the drive shaft when the projection of the drive claw engages one of the grooves. However, during type selection, a selection claw engages teeth of a selection ratchet to stop the rotation of same, so that when an engagement means of the selection ratchet engages the drive claw, the projection of the drive claw disengages from the groove of the drive shaft, so as to detach the rotation transmitting relationship between the drive shaft and the printing wheel.

6 Claims, 28 Drawing Figures

TYPE SELECTION MECHANISM FOR A PRINTER

FIELD OF THE INVENTION

This invention relates to a printer, and more particularly to a printer having an improved type selection mechanism adapted to reliably stop the rotation of printing wheels.

BACKGROUND OF THE INVENTION

There is conventionally proposed a printer including a platen on which printing paper is rolled up, a rotary shaft disposed parallel to the platen, and a plurality of, e.g. 18 printing wheels having types along their circumferential margins and mounted on the rotary shaft, so as to effect a desired printing by controlling rotating amounts of the respective printing wheels. FIG. 16 shows a fragmentary view of such a prior art printer disclosed by Japanese Utility Model Publication No. 55-21798.

In FIG. 16, reference numeral 101 designates a rotary shaft, 102 denotes a printing wheel mounted on the rotary shaft 101. The printing wheel 102 has a bearing 102*a* receiving the rotary shaft 101, a group of types 102*b* along the circumferential margin thereof, and a selection ratchet 102*c* encircling the bearing 102*a*. Reference numeral 103 designates a drive claw which transmits the rotation of the rotary shaft 101 to the printing wheel 102. The drive claw 103 includes a shaft portion 103*a* inserted in a circular, recess 102*e* provided between the bearing 102*a* and selection ratchet 102*c*, a short and rigid first arm 103*c* having a claw portion 103*b* at the distal end thereof, and a long and resilient second arm 103*d*. The drive claw 103 is supported on the bearing 102a by the claw portion 103*b* inserted in a slit 102*d* of the bearing 102*a*. The claw portion 103*b* is engageable with a slit 101*a* provided in the rotary shaft 101 and defined by a radially oriented surface 101*b* and an opposed surface 101*c* angled with respect to the surface 101*b*. Reference numeral 104 denotes a selection claw engageable with the selection ratchet 102*c* and rotatable about an axle 105.

In this printer, when the rotary shaft 101 is rotated in arrow R direction while the claw portion 103*b* of the drive claw 103 engages the slit 101*a* of the rotary shaft 101, the rotation of the rotary shaft 101 is transmitted to the printing wheel 102 via the drive claw 103 so as to rotate the printing wheel 102. Also, the selection claw 104 pivots in arrow S direction and engages the selection ratchet 102*c*, so that the rotation of the selection ratchet 102*c*, i.e. the printing wheel 102 is stopped to place a desired type 102*b* at the printing position. The rotary shaft 101 continues its rotation for type selection of other printing wheels after the printing wheel 102 is held stationary. However, the rotation of the rotary shaft 101 is not transmitted because a confronting surface of the claw portion 103*b* of the drive claw 103 slides on the surface 101*c* of the slit 101*a* so as to expand the drive claw 103 against the resiliency of the second arm 103*d*.

The prior art printer, however, has some drawbacks to be improved as described below.

Transmission of the rotation from the rotary shaft 101 to the printing wheel 102 depends on a frictional force between the wall surface 101*c* of the slit 101*a* of the rotary shaft 101 and the opposed surface of the drive claw 103*b*. Therefore, the drive claw 103 is apt to disengage from the rotary shaft 101 due to a significant inteteria force caused by a sudden interruption of a high speed rotation or a rotation startup. Also, some kinds of external load to the printing wheel 102 would cause the drive claw 103 to disengage from the rotary shaft 101. To eliminate such a disengagement, it would be necessary to increase the resiliency of the second arm 103*d* of the drive claw 103. However, a large resiliency of the drive claw 103 and those of other drive claws associated with other printing wheels cause a significant increase in the torque for driving the rotary shaft 101 after one or more printing wheels are held stationary, and hence require a large-scaled motor for driving the rotary shaft 101, which increases the manufacturing cost as well as the running cost due to a large power consumption.

To overcome these drawbacks, the present Applicant proposed a printer shown in FIG. 17 and disclosed in Japanese patent application No. 60-4851. In FIG. 17, reference numeral 106 designates a selection ratchet mounted for relative and concurrent rotation with respect to the printing wheel 102, and 107 denotes a drive claw interposed between the printing wheel 102 and selection ratchet 106 to transmit the rotation of the rotary shaft 101 to the printing wheel 102. The drive claw 107 includes a hole 107*a* relatively rotatably receiving a shaft 102*f* provided on the printing wheel 102, a projection 107*b* engageable with a groove 101*a* of the rotary shaft 101, a rigid first arm 107*c* and a resilient second arm 107*d*. The selection ratchet 106 includes a series of teeth 106*b* along the circumferential margin thereof and a guide recess 106*a* receiving the distal end of the first arm 107*a* of the drive claw 107 to rotate the drive claw 107 about the shaft 102*f*. Reference numeral 108 designates a selection claw placed outward of and opposed to the selection ratchet 106. Other members corresponding to those of FIG. 16 are designated by the same reference numerals.

In this prior art printer, as shown in FIG. 17(*a*), when the rotary shaft 101 rotates in arrow 109 direction while the projection 107*b* of the drive claw 107 engages the groove 101*a* of the rotary shaft 101, the rotation of the rotary shaft 101 is transmitted to the printing wheel 102 via the drive claw 107 to rotate the printing wheel 102. Also as shown in FIG. 17(*b*), the selection claw 108 is driven by an electromagnetic clutch or other means (not shown) so that the distal end thereof engages the teeth 106*b* of the selection ratchet 106 to establish a unitary relationship with the selection ratchet 106. With a further rotation of the drive shaft 101, maintaining the unitary relationship with the selection ratchet 106, the distal end of the first arm 107*c* of the drive claw 107 moves outward along the guide recess 106*a* of the selection ratchet 106 to disengage the projection 107*b* of the first arm 107*c* from the slit 101*a* of the rotary shaft 101. Therefore, the printing wheel 102 looses the rotational force from the rotary shaft 101.

In this prior art printer, the selection ratchet 106 is a separate member from the printing wheel 102 and is provided with the guide recess 106*a* for pivotally engaging the drive claw 107, so that during type selection, the rotation of the rotary shaft 101 is transmitted to the printing wheel 102 via the surface intersecting the rotating direction of the rotary shaft 101 and with no substantial friction between the rotary shaft 101 and projection 107*b*. Therefore, the resiliency of the drive claw 107 can be rendered smallest also in high-speed rotation, and can decrease the torque for driving the rotary shaft 101. However, there still remains a problem in the prior art printer.

Since the printing wheel 102 and the separate selection ratchet 106 are relatively rotatably mounted, the printing, wheel 102 held stationary to place a selected type thereof at the printing position is apt to rotate slightly on possible application of an external force, e.g. a pivoting power of a hammer, which causes a positional error in the printed letters or numbers.

OBJECT OF THE INVENTION

It is therefore an object of the invention to provide a printer which can reliably hold the printing wheels stationary.

SUMMARY OF THE INVENTION

To attain the object of the invention, there is provided a printer comprising:

a drive shaft having an axial slit on the circumferential surface thereof;

printing wheels rotatably mounted on the drive shaft and each having a group of types along the circumferential margin thereof;

a drive shaft supported by each said printing wheel and having a projection engageable with said slit of the drive shaft;

a selection ratchet rotatably connected to each said printing wheel via said drive claw and having an engage portion engageable with said drive claw and a series of teeth along the circumferential margin thereof; and a selection claw engageable with said teeth to selectively stop the rotation of said selection ratchet;

said groove of the drive shaft engaging said projection of said drive claw to transmit the rotation from said drive shaft to said printing wheel, said selection claw latchingly engaging said teeth of said selection ratchet upon type selection to engage said engage portion of said selection ratchet with said drive claw and disengage said projection of said drive claw from said slit of said drive shaft to detach the rotation transmitting relationship between the drive shaft and printing wheel.

When a pivoting power from a hammer is applied to the type surface of the printing wheel, said selection claw engages one of lock notches provided on said printing wheel to reliably hold said printing wheel stationary at a printing position.

With this arrangement, when the selection claw latchingly engages the selection ratchet upon type selection, the drive claw co-rotatable with the drive shaft and the printing wheel abuts one of engage portions of the selection ratchet determined by the rotating direction, and is expanded outwardly by a subsequent rotation of the drive shaft, so that the projection of the drive claw disengages from the slit of the drive shaft to shut the rotation transmission from the drive shaft to the printing wheel. At this time, if the distal end of the selection claw also engages the lock notch of the printing wheel, the printing wheel is reliably held unrotatable at its printing position against a pivoting power from the hammer applied thereto during a subsequent printing operation.

These and other aspects and features of the invention will become apparent upon making reference to the specification and drawings to follow.

BRIEF DESCRIPTION OF THE DRAWINGS

FIGS. 1 through 15 illustrate various aspects of a printer embodying the invention, in which:

FIG. 1 is a simplified lateral elevation of the printer;

FIG. 2 is a front elevation of a printing wheel;

FIG. 3 is a front elevation of a selection ratchet;

FIG. 4 is an exploded perspective view of the printing wheel, selection ratchet, drive claw, selection claw and electromagnetic clutch;

FIGS. 5(*a*) through 5(*c*) show the relationship between the drive shaft and drive claw;

FIGS. 6(*a*) through 6(*c*) show the relationship between the selection ratchet and selection claw;

FIG. 7(*a*) is a plan view of a hammer;

FIG. 7(*b*) is a cross-sectional view taken along the E—E line of FIG. 7(*a*);

FIG. 8 is a plan view of a misprinting preventive plate;

FIG. 9 is a perspective view of a roll support member and ink rolls;

FIG. 10 is a perspective view of a changeover cam;

FIGS. 11(*a*) through 11(*c*) show the relationship between the roll support member and changeover cam;

FIGS. 12(*a*) through 12(*c*) show the relationship between the ink rolls and printing wheel;

FIG. 13 is a timing chart showing relationships between various actions during one line printing;

FIG. 14 simply shows a power transmitting arrangement; and

FIGS. 15(*a*) and 15(*b*) show a claw clutch mechanism equipped in the power transmitting arrangement.

DETAILED DESCRIPTION

Figure 1:
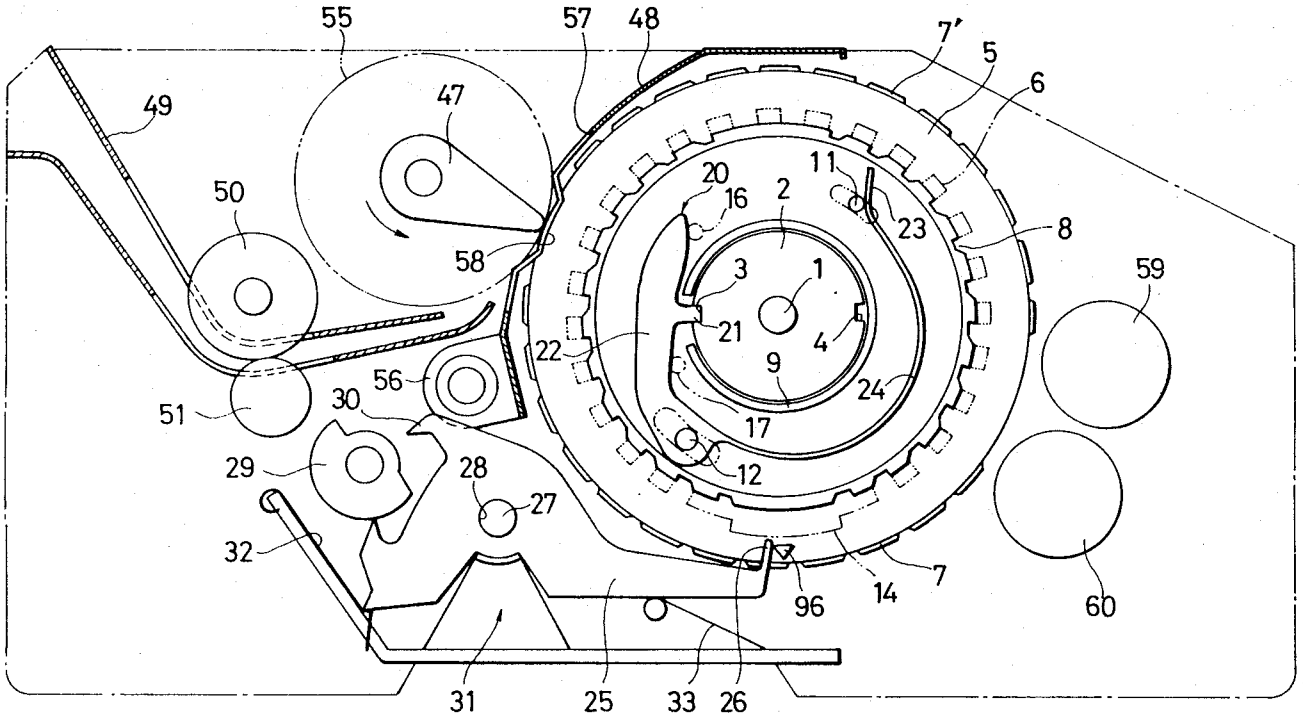

The invention is hereinbelow described in detail, referring to a preferred embodiment illustrated in the drawings.

FIG. 1 is a general side elevation of a printer embodying the invention. Reference numeral 1 designates a rotary shaft rotated in opposite directions by a power applied thereto from a motor (not shown) via a gear system which will be described later. Reference numeral 2 denotes a drive shaft co-rotatable with the rotary shaft 1 and having two symmetrical slits 3 and 4 extending in the axial direction along the outer peripheral surface thereof. Reference numeral 5 denotes a printing wheel mounted on the drive shaft 2, and 6 designates a selection ratchet also mounted on the drive shaft 2.

Figure 2:
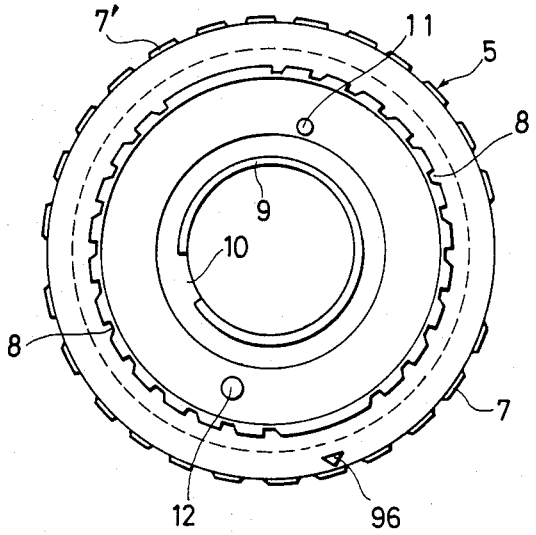
Figure 3:
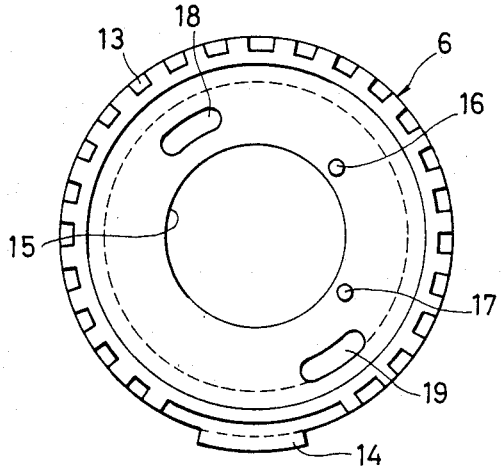

FIG. 2 is a plan view of the printing wheel 5, and FIG. 3 is a front elevation of the selection ratchet 6. As best shown in FIG. 2, the printing wheel 5 has on the outermost peripheral surface thereof two series of printing types 7 and 7' representing numbers, symbols and letters such as "0, 1, 2, . . . 9, +, −, ×, ÷" and others. Along an inner circumferential margin of the printing wheel 5 are provided a plurality of lock notches 8-8 corresponding to the individual types 7-7'. In a central portion of the printing wheel 5, a bearing 9 projects vertically to accept the drive shaft 2 therein. The bearing 9 has a slit 10. At radially outward positions of the bearing 9, an engagement pin 11 and a support pin 12 are embedded at substantially opposite positions with respect to the axis of the printing wheel 5.

As best shown in FIG. 3, the selection ratchet 6 has on the outer peripheral surface thereof a plurality of teeth 13-13 corresponding to the types 7-7' and a single engagement projection 14. At a central portion of the ratchet 6 is provided a hole 15 which accepts the bearing 9 of the printing wheel 5. At radially outward positions of the hole 15 a pair of spaced release pins 16-17 project vertically, and a pair of engagement holes 18-19 are formed to loosely accept the engagement pin 11 and support pin 12 of the printing wheel 5.

Referring back to FIG. 1, reference numeral 20 designates a drive claw provided between the printing wheel and the selection ratchet 6 to transmit the rotation of the rotary shaft 1 to the printing wheel 5. The drive claw 20 includes a rigid first arm 22 and a resilient second arm 24. The first arm 22 has a projection 21 engageable with the slits 3-4 of the drive shaft 2, and the proximal end thereof is rotatably supported by the support pin 12 of the printing wheel 5. The second arm 24 of the drive claw 20 has a slide portion 23 resiliently engaging the engagement pin 11 of the printing wheel 5. As shown in FIG. 2 by a dotted line, both release pins 16 and 17 of the selection ratchet 6 are located near the first arm 22 through the projection 21 of the drive claw 20, and the top ends of the engagement pin 11 and support pin 12 of the printing wheel 5 are located in the engagement holes 18-19 of the selection ratchet 6, respectively.

Reference numeral 25 in FIG. 1 denotes a selection claw which engageably stops the rotation of the selection ratchet 6. The selection claw 25 has at one end thereof a claw portion 26 engageable with the teeth 13 and engagement projection 14 of the selection ratchet 6 and also engageable with the lock notches 8 of the printing wheel 5. The selection claw 25 is also provided with a hole 23 at a central portion thereof for accepting a rotary shaft 27, and has at the other end thereof a cam claw 30 engaging a reset cam 29. Reference numeral 31 denotes a drive means, i.e. an electromagnetic clutch which selectively transmits rotation of the rotary shaft 27 to the selection claw 25. Reference numeral 32 designates a holding spring which holds the selection claw 25 at a position for engagement with the selection ratchet 6. Reference numeral 33 denotes a push spring which cooperates with the holding spring 32 to hold the selection claw 25 apart from the selection ratchet 6.

Figure 4:
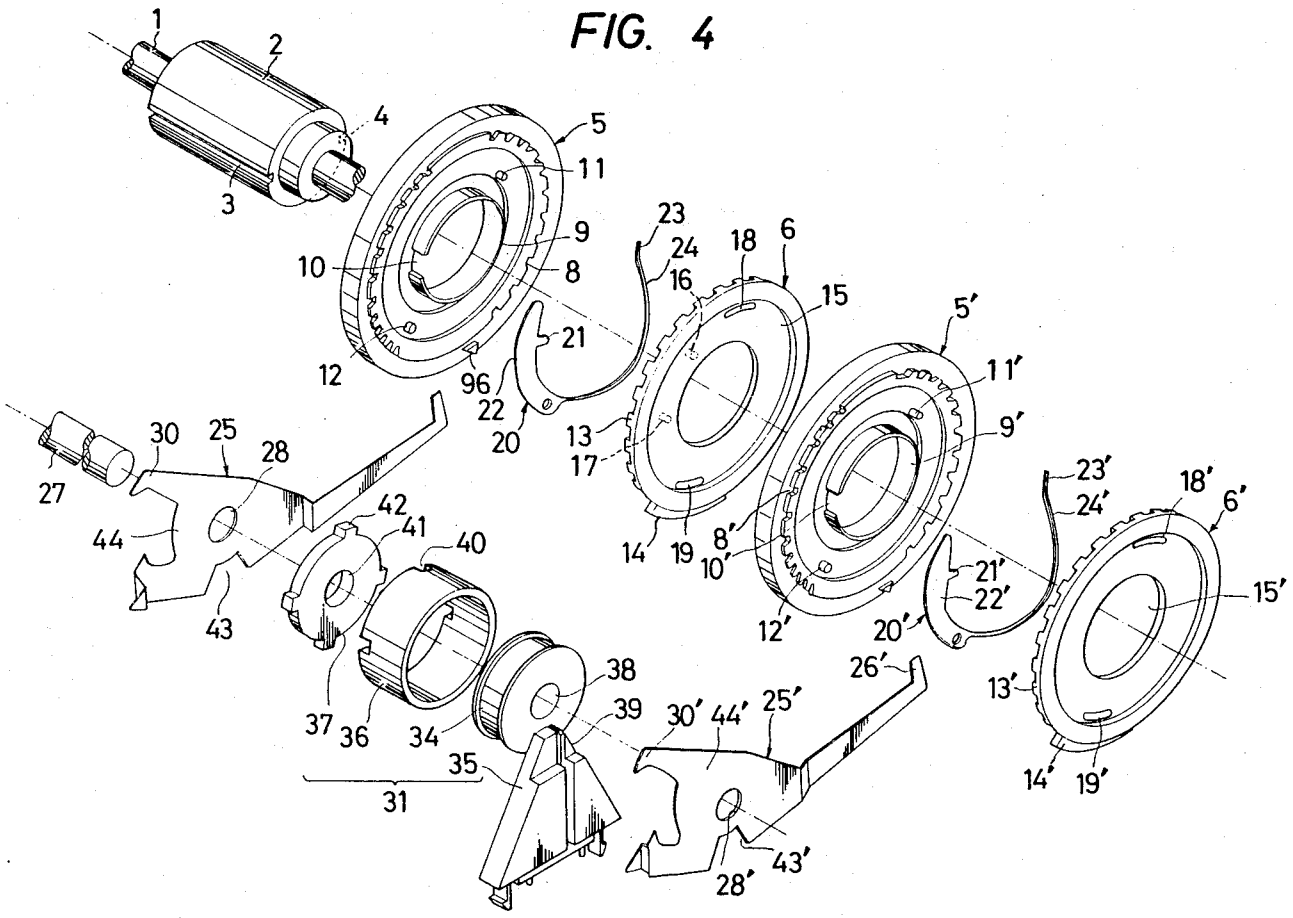

FIG. 4 is an exploded perspective view showing relationships between the printing wheel 5, selection ratchet 6, drive claw 20, selection claw 25 and electromagnetic clutch 31. As best shown in FIG. 4, the electromagnetic clutch 31 generally comprises an electromagnetic coil 34, support base 35, yoke 36 and rotary member 37. The electromagnetic coil 34 has a central hole 38 accepting the rotary shaft 27 therein and is held at a sectorial projection 39 at the top of the holding base 35. The cylindrical yoke 36 encircles the electromagnetic coil 34 and has at one end thereof four notches 40-40 at 90° interval. The rotary member 37 is made of a non-magnetic material and has a central hole 41 accepting the rotary shaft 27 therein to rotate together. The rotary member 37 has along the circumference thereof four projections 42-42 at 90° interval for engagement with the notches 40-40 of the yoke 36. With this arrangement, the electromagnetic clutch 31 can rotate two selection claws, e.g. a first selection claw 25 and a second selection claw 25'. The first and second selection claws 25-25' have, as described above, end claws 25-25' at their top ends, holes 28-28' at their center and cams 30-30' at their other ends. These selection claws 25-25' further include at lower portions thereof relatively large sectorial recesses 43-43' corresponding to the configuration of the sectorial projection 39 of the holding base 35.

On assembling the first and second selection claws 25-25' and the electromagnetic clutch 31, the yoke 36 is encirclingly mounted on the electromagnetic coil 34, and the individual projections 42 of the rotary member 37 are dropped in the notches 40-40 of the yoke 36. Additionally, the selection claws 25-25' are rotatably mounted on the rotary shaft 27, and their sectorial recesses 43-43' are fit to the sectorial projection 39 of the holding base 35. As described above, the rotary member 37 is provided integrally with the rotary shaft 27. When they are mounted together, plate portions 41-41' of the selection claws 25-25' are opposed to both ends of the yoke 36.

The printing wheel 5, selection ratchet 6 and drive claw 20 are mounted on the drive shaft 2 in the following manner. The bearing 9 of the first printing wheel, for example, is mounted on the drive shaft 2, and the drive claw 20 is mounted subsequently, with the support pin 12 of the first printing wheel 5 passing through a hole of the drive claw 20, the projection 21 of the first arm 22 of the drive claw 20 being inserted in the slit 10 of the bearing 9, and the projection 21 being engaged in the slit 3, for example, of the drive shaft 2. The second arm 24 of the drive claw 20 is located so that the slide portion 23 thereof resiliently contacts the engagement pin 11 of the first printing wheel 5. Subsequently, the first selection ratchet 6 is mounted, with the hole 15 thereof receiving the bearing 9 of the first printing wheel 5 therein, the release pins 16-17 being located inward of the first arm 22 of the drive claw 20, and the engagement holes 18-19 thereof being located at the engagement pin 11 and support pin 12 of the first printing wheel 5.

A second group of printing wheel 5', selection ratchet 6' and drive claw 20' are also mounted on the drive shaft 2 in the same manner. More specifically, the second printing wheel 5' is mounted on the drive shaft 2, receiving the shaft 2 in the bearing 9', and the drive claw 20' is mounted subsequently, with a hole thereof receiving the support pin 12' of the second printing wheel 5' therein, the projection 21' of the first arm 22' thereof being inserted in the slit 10' of the bearing 9' and further inserted in the slit 3 of the drive shaft 2, and the slide portion 23' of the second arm 24' thereof being located for resilient contact with the engagement pin 11' of the second printing wheel 5'. Subsequently, the second selection ratchet 6' is mounted, with the hole 15' receiving the bearing 9' therein, the release pins (not shown) being located inward of the first arm 22' of the second drive claw 20', and the engagement holes 18'-19' being located at the engagement pin 11' and support pin 12' of the second printing wheel 5'.

Between the first group of printing wheel 5 and selection ratchet 6 and the second group of printing wheel 5' and selection ratchet 6' both mounted on the drive shaft 2 is provided a phase difference, i.e. one half pitch difference so that one tooth 13' of the second selection ratchet 6' is located between adjacent two teeth 13-13 of the first selection ratchet 6.

Although not shown, the printer includes a number of sets, e.g. nine sets of the illustrated arrangement aligned in the axial direction of the drive shaft 2 and rotary shaft 27 which each set comprises two printing wheels 5-5', selection ratches 6-6', drive claws 20-20', selection claws 25-25', and one electromagnetic clutch 31 as illustrated.

Figure 5A:
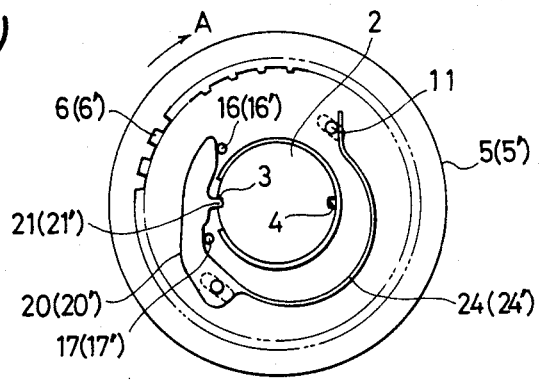
Figure 5B:
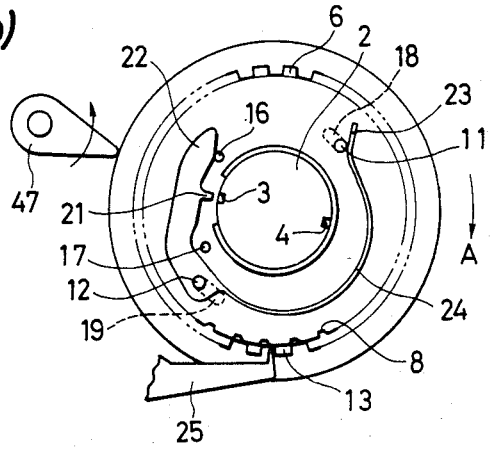
Figure 5C:
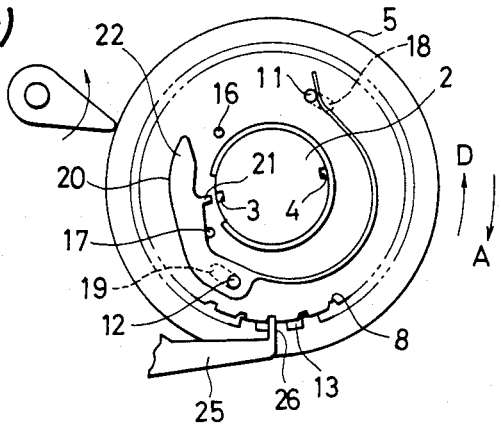
Figure 6A:
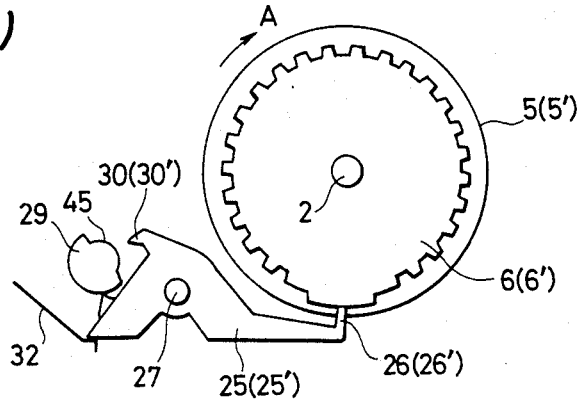
Figure 6B:
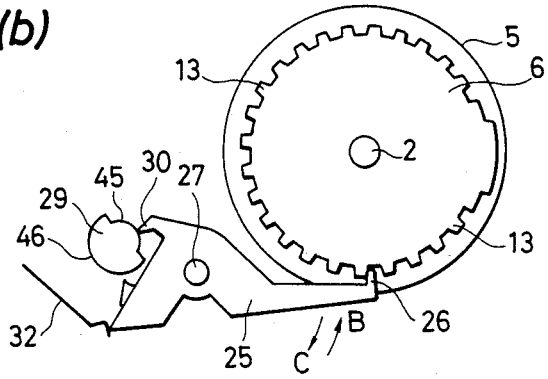
Figure 6C:
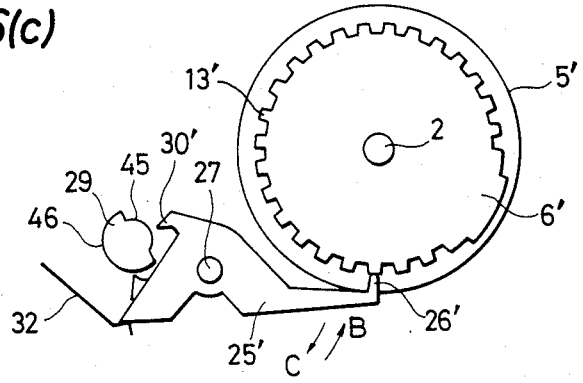

FIGS. 5 (*a*) through 5 (*c*) show how the drive claw 20(20') engages the drive shaft 2, and FIGS. 6(*a*)

through 6(*c*) show how the selection ratchet 6(6') engages the selection claw 25(25'). Principally referring to these drawings, type selecting operation of the printing wheel 5(5') is hereinbelow explained.

In FIG. 5(*a*), the projection 21(21') of the drive claw 20(20') is received in the slit 3 of the drive shaft 2. In FIG. 6(*a*), the distal end of the selection claw 25(25') is in a stand-by condition where it does not yet pass over a bulging portion of the holding spring 32(32'). When the drive shaft 2 and rotary shaft 27 are rotated by a motor (not shown) in arrow A direction in FIGS. 5(*a*) to 5(*c*) and 6(*a*), the rotation of the drive shaft 2 is transmitted to the drive claw 20(20') via engagement between the projection 21(21') and the slit 3. This rotation is further transmitted to the release pins 16-17(16'-17') via the first arm 22(22') of the drive claw 20(20'), so that the printing wheel 5(5'), selection claw 6(6') and drive shaft 2 rotate together in arrow A direction. It should be noted, however, that the rotation of the rotary shaft 27 causes pivotal movements of the rotary member 27 and yoke 36, but the selection claw 25(25') does not receive the rotation of the rotary shaft 27 and is held in a stand-by condition shown in FIG. 6(*a*).

Upon energization of the electromagnetic coil 34 when a desired type 7 or 7' of the first printing wheel 5 (for example) reaches a printing position, the plate portion 44 of the selection claw 25 is attracted to the end edges of the yoke 36. Therefore, the selection claw 25 tends to rotate together with the yoke 36 in arrow B direction in FIG. 6(*b*) and 6(*c*). However, since the first selection claw 25 takes a position where its claw portion 26 is located between adjacent teeth 13-13 of the first selection ratchet 6, the distal end of the first selection claw 25 rotates in arrow B direction over the bulging portion of the holding spring 32 as shown in FIG. 6(*b*), and the first selection ratchet 6 stops. This stationary condition is reliably maintained by the resilient energy of the holding spring 32. After the first selection ratchet 6 is stopped by the first selection claw 25, a subsequent rotation of the drive shaft 2 in arrow A direction in FIG. 5(*a*) causes the distal end of the first arm 22 of the drive claw 20 to engage the release pin 16 of the first selection ratchet 6 and move outwardly. That is, the drive claw 20 is stretched against the resilient energy of the second arm 24. Due to this, the projection 21 of the first arm 22 disengages from the slit 3 of the drive shaft 2 as shown in FIG. 5(*b*), and the rotation of the drive shaft 2 is not transmitted to the first selection ratchet 6 and first printing wheel 5. At that time, the engagement pin 11 and support pin 12 of the first printing wheel 5 engage ends of the engagement holes 18-19 of the first selection ratchet 6 as shown in FIG. 5(*b*) to prohibit a further movement of the first printing wheel 5 with respect to the first selection ratchet 6. Since the slide portion 23 at the distal end of the second arm 24 is bent in its expanding direction for slidable contact with the engagement pin 11 of the first printing wheel 5, the frictional force therebetween is relatively small while the second arm 24 of the drive claw 20 is expanded. Additionally, the engagement pin 11 is located in the opposite position of the support pin 12 with respect to the axis of the drive shaft 2 so as to provide the longest extension of the second arm 24 to decrease its spring constant. These arrangements ensure a large engaging force during engagement between the projection 21 and slit 3 or 4 and a small load during out-of-engagement thereof.

The second selection claw 25' which is different in phase by a half pitch is held stationary at a position where the claw portion 26' thereof is opposed to one tooth 13' of the second selection ratchet 6' as shown in FIG. 6(*c*). Therefore, the second ratchet 6' and second printing wheel 5' continue their rotations. When the electromagnetic coil 34 is deenergized synchronously with interruption of the rotation of the first printing wheel 5 (for example) the rotation of the rotary shaft 27 is not transmitted to the second selection claw 25' to allow same to restore its stand-by condition shown in FIG. 6(*a*) with the energy of the holding spring 32. Due to this, the second selection claw 25' does not engage the second selection ratchet 6' regardless of rotation of the drive shaft 2.

When a desired type 7 or 7' on the second printing wheel 5' reaches the printing position, the electromagnetic coil 34 is energized so that the second printing wheel 5' in the stand-by condition is fixed in position as shown in FIG. 6(*b*) in the same fashion as the first printing wheel 5. This position fixture of types applies to all types on any other printing wheels not shown.

When the claw portions 26-26' of the selection claws 25-25' engages the teeth 13-13' of the selection ratchet 6-6' as described above, i.e. while a type selecting operation is effected, the cam claws 30-30' of the selection claws 25-25' are opposed to a small diameter portion 45 of the reset cam 29 as shown in FIG. 6(*b*). After the printing operation is terminated, the reset cam 29 is rotated so that a large diameter portion 46 thereof contacts the cam claws 30-30' of the selection claws 25-25'. Due to this, all selection claws including 25-25' rotate in arrow C direction of FIGS. 6(*b*) and 6(*c*), passing over the bulging portion of the holding spring 32, and are held in their stand-by condition again by the bulging portion of the holding spring 32 and push spring 33. When the selection claws 25-25' rotate oppositely in this manner, they disengage from the selection ratchet 6-6'. When the drive shaft 2 is subsequently rotated in arrow A direction in FIG. 5 (*a*), for example, projections 21-21' of the drive claws 20-20' slip along the peripheral surface of the drive shaft 2 until the slit 3 or 4 reaches a position opposed to the projections 21-21' where the projections 21-21' drop in the slit 3 or 4 with the resilient energy of the second arms 24-24' of the drive claws 20-20' to establish the power transmitting configuration between the drive shaft 2, selection ratchets 6-6' and printing wheels 5-5'. This sequential operation also applies to all selection claws, drive claws, selection ratchets and printing wheels in any other sets of arrangements not shown.

The described sequential operation is based on the drive shaft 2 rotated in arrow A direction in FIG. 5(*a*). However, an opposite rotation of the drive shaft 2 in arrow D direction in FIG. 5(*c*) also results in the substantially same operation. More specifically, as shown in FIG. 5(*c*), when the rotation of the selection ratchet 6, for example, is stopped by engagement between the tooth 13 and the selection claw 25, a subsequent rotation of the drive shaft 2 in arrow D direction in FIG. 5(*c*) causes the release pin 17 of the selection ratchet 6 to engage a central portion of the first arm 22 of the drive claw 20 and push same outwardly. Therefore, the projection 21 of the first arm 22 disengages from the slit 3 of the drive shaft 2 to interrupt transmission of the rotation from the drive shaft 2 to the selection ratchet 6 and printing wheel 5. In this case, however, since the rotating direction of the drive shaft 2 is opposite to the rotational force received by the printing wheel 5 upon a pivotal movement of a hammer which will be described later, the claw portion 26 of the selection claw 25 engages the lock notches 8 of the printing wheel 5 as shown in FIG. 5(*c*) to prevent an undesired rotation of a selected printing wheel 5. In this respect, a further explanation is given in a later passage entitled "Printing".

Referring back to FIG. 1, reference numeral 47 designates a hammer opposed to the array of types on the printing wheel 5, 48 denotes a misprint preventive plate located between the printing wheel 5 and hammer 47, 49 refers to a paper guide which guides printing paper (not shown) to a proper printing position, 50 refers to a paper feeding roller located near the paper guide 49, and 51 denotes a follower roller opposed to the paper feeding roller 50 to closely sandwich the print paper therebetween to transport same.

Figure 7A:
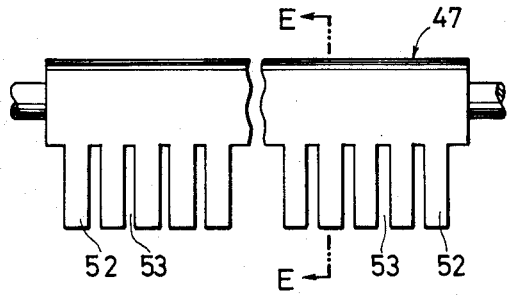
Figure 7B:
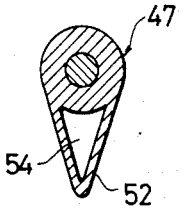

FIG. 7(*a*) is a plan view of the hammer 47, and FIG. 7(*b*) is a cross-sectional view taken along E—E line of FIG. 7(*a*). The hammer 47 has a plurality (eighteen, for example) of bulging press portions 52-52 corresponding to the number of the printing wheels 5-5. The respective press portions 52-52 are spaced by slits 53-53. The hammer 47 is made of a relatively hard synthetic resin material, for example, and has inner spaces 54-54 formed in the individual press portions 52-52 to provide a resiliency, maintaining a sufficient hardness at their outer surfaces. Additionally, the spaced or separate configuration of the press portions 52-52 never fails to provide a uniform hitting power on each printing wheel if the hammer 47 or printing wheel are more or less deviated. Reference numeral 55 labelled to a two-dot-dash line in FIG. 1 designates the orbit of the distal end of the hammer 47, i.e. the distal end of the press portion 52.

Figure 8:
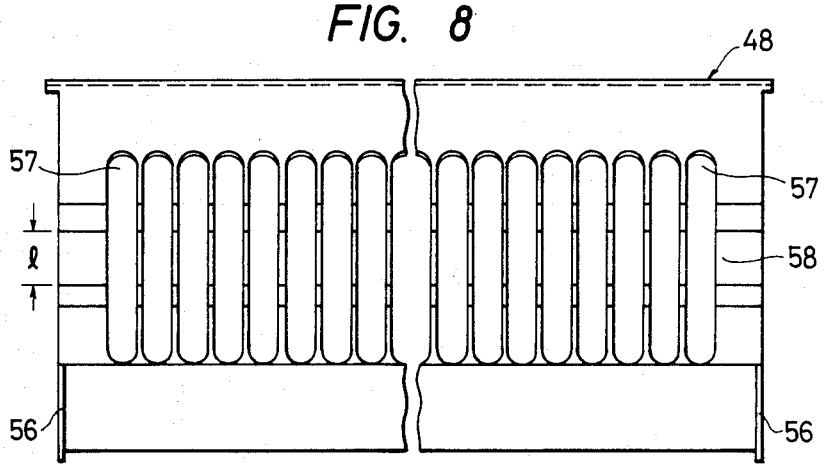

FIG. 8 is a plan view of the misprint preventive plate 48. As shown in FIGS. 1 and 8, the misprint preventive plate 48 is made by bending a metal sheet, for example, and has at both lower ends thereof fixing extensions 56-56. The misprint preventive plate has a plurality of holes 57-57 aligned and spaced in the length direction thereof. The number of the holes 57-57 corresponds to the number (eighteen, for example) of the printing wheels 5-5. The types 7-7' on each printing wheel 5 are exposed to the hammer 47 through the hole 57. As best shown in FIG. 1, a central portion of the misprint preventive plate 48 where the hole 57 is formed is bent to project toward the array of types, and the length (l in FIG. 8) of the projecting portion 58 is substantially equal to one type 7 or 7' on the printing wheel 5. Therefore, only a single type at the printing position is exposed to the hammer 47 through the hole 57, projecting nearer to the hammer than the level of the projecting portion 58, whereas other types adjacent the selected type, although opposed to the hole 57, never project through the hole 57.

Figure 9:
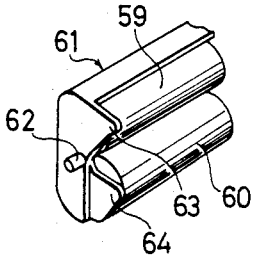

Still referring to FIG. 1, reference numeral 59 designates a first ink roll which may contain red ink, and 60 denotes a second ink roll which may contain black ink. The first and second ink rolls 59-60 as best shown in FIG. 9 are rotatably supported by a roll support member 61 which has support shafts 62-62 (only one is illustrated) provided at both ends thereof and pivotably and slidably supported by a chassis (not shown), for example. The roll support member 61 is normally biased by a resilient member (not shown) toward the axis of the drive shaft 2. The roll support member 61 has a first cam claw 63 and a second cam claw 64 formed along one lateral end thereof with a slight positional difference in the axial direction of the ink rolls 59-60.

Figure 10:
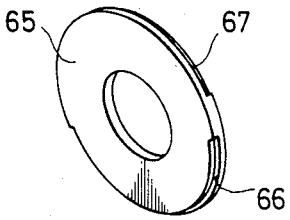

These ink rolls 59-60 and roll support member 61 are driven by a changeover cam 65 shown in FIG. 10. The changeover cam 65 (not shown in FIG. 1) is mounted integrally with and outside the outermost printing wheel, for example, and pivotable therewith. As shown in FIG. 10, the changeover cam 65 has a first cam groove 66 extending substantially over a half circle along the outer circumference of one surface thereof and a second cam groove 67 extending substantially over the other half circle along the outer circumference of the other surface thereof. The first cam claw 63 of the roll support member 61 is opposed to the first cam groove 66 of the changeover cam 65 whereas the second cam claw 64 is opposed to the second cam groove 67.

Figure 11A:
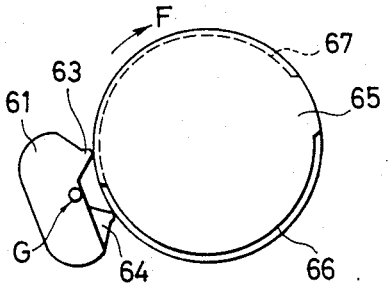
Figure 12A:
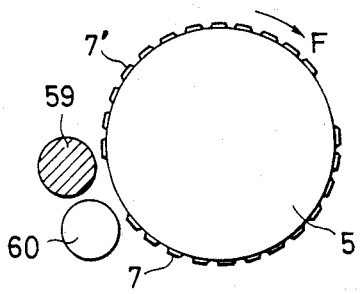
Figure 11B:
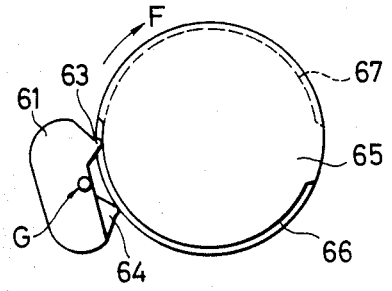
Figure 12B:
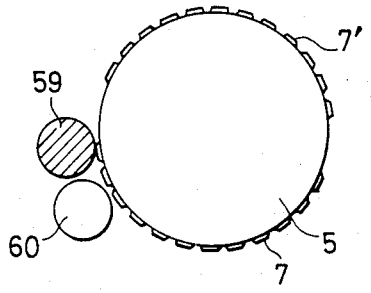
Figure 11C:
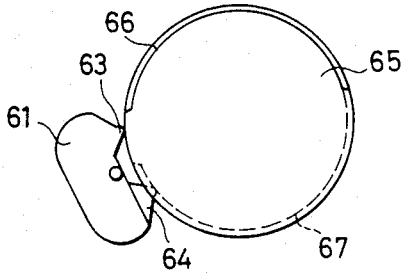
Figure 12C:
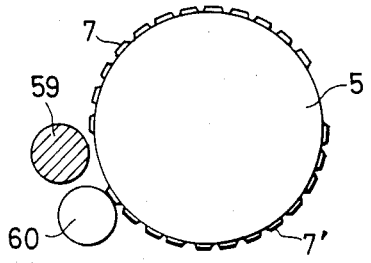

FIG. 11 shows the relationship between the roll support member 61 and changeover cam 65, and FIG. 12 shows the relationship between the ink rolls 59-60 and printing wheel 5. Majorly referring to FIGS. 11 and 12, inking operation of the ink rolls 59-60 is hereinbelow described.

In FIG. 11(*a*), the first cam claw 63 of the roll support member 61 is out of the first cam groove 66 of the changeover cam 65. The second cam claw 64 of the roll support member 61 is out of the second cam groove 67 of the changeover cam 65. That is, both cam claws 63-64 engages the outer peripheral surface of the changeover cam 65. In this condition, as shown in FIG. 12(*a*), both ink rolls 59-60 are apart from the types 7-7' on the printing wheel 5. When the changeover cam 65 is rotated in arrow F direction in FIG. 11(*b*), the first cam claw 63 drops in the first cam groove 66 due to a resilient force in arrow G direction. However, the second cam claw 64 still remains on the outer peripheral surface of the changeover cam other than the second cam groove 67, so that as shown in FIG. 12(*b*) the first ink roll 59 is forcibly brought into contact with the first type 7 on the printing wheel 5. This configuration is maintained while the first cam claw 63 is received in the first cam groove 66 and before the second cam claw 64 drops in the second cam groove 67, so that ink in a desired color, e.g. red, of the first ink roll 59 is applied throughout the array of the first types 7-7 on the printing wheel 5.

When the changeover cam 65 rotates about 180 degrees in arrow F direction from the position of FIG. 11(*a*) until the first ink roll 59 completes its inking to the final type 7 on the printing wheel 5, the first cam claw 63 heretofore received in the first cam groove 66 gets out of the groove 66 and rides on the peripheral surface of the changeover cam 65, whereas the second cam claw 64 drops in the second cam groove 67 as shown in FIG. 11(*c*). Due to this, as shown in FIG. 12(*c*), the first ink roll 59 moves away from the first types 7, and the second ink roll 60 is compressed to the second type array 7'. This configuration is maintained during a subsequent rotation of the changeover cam 65 substantially over a half revolution, so that ink in a desired color, e.g. black, of the second ink roll 60 is applied throughout the array of the second types 7'-7' on the printing wheel 5. With such a full rotation of the changeover cam 65 from the position of FIG. 11(*a*), the first and second cam claws 63-64 both engage the outer peripheral surface of the changeover cam 65 other than the first and second cam grooves 66-67, and both ink rolls 59-60 move away from the type arrays 7-7' as shown in FIG. 12(*a*). These motions also apply when the changeover cam 65 is rotated in the opposite direction. Whichever direction the changeover cam 65 rotates, a first half revolution of the changeover cam 65 brings one of the ink rolls 59-60 into contact with the type array 7 or 7', and a subsequent half revolution of the changeover cam 65 brings the other ink roll 59 or 60 into contact with the type array 7' or 7.

The rotary shaft 1, reset cam 29, hammer 47, changeover cam 65 and others are controlled in rotation by a power transmitting system which is explained hereinbelow, referring to FIGS. 13 through 15.

Figure 13:
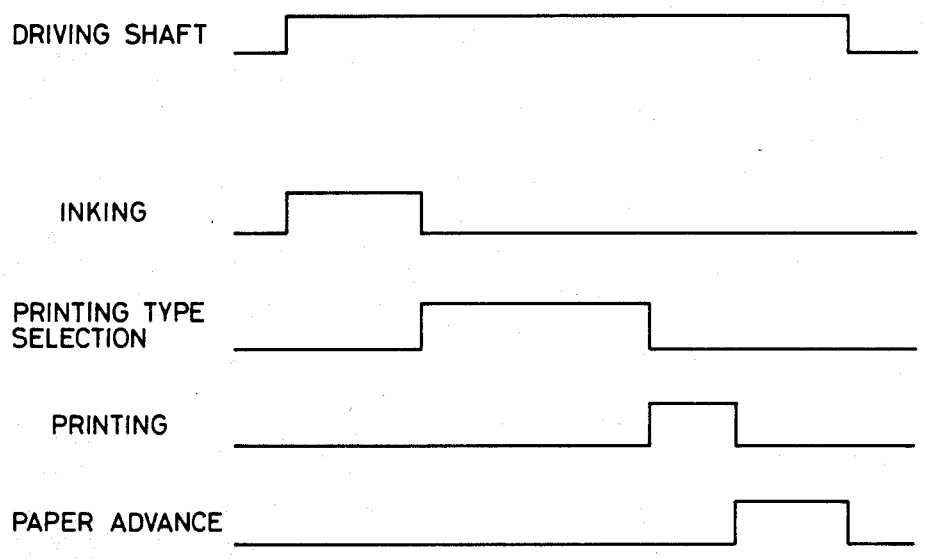
Figure 14:
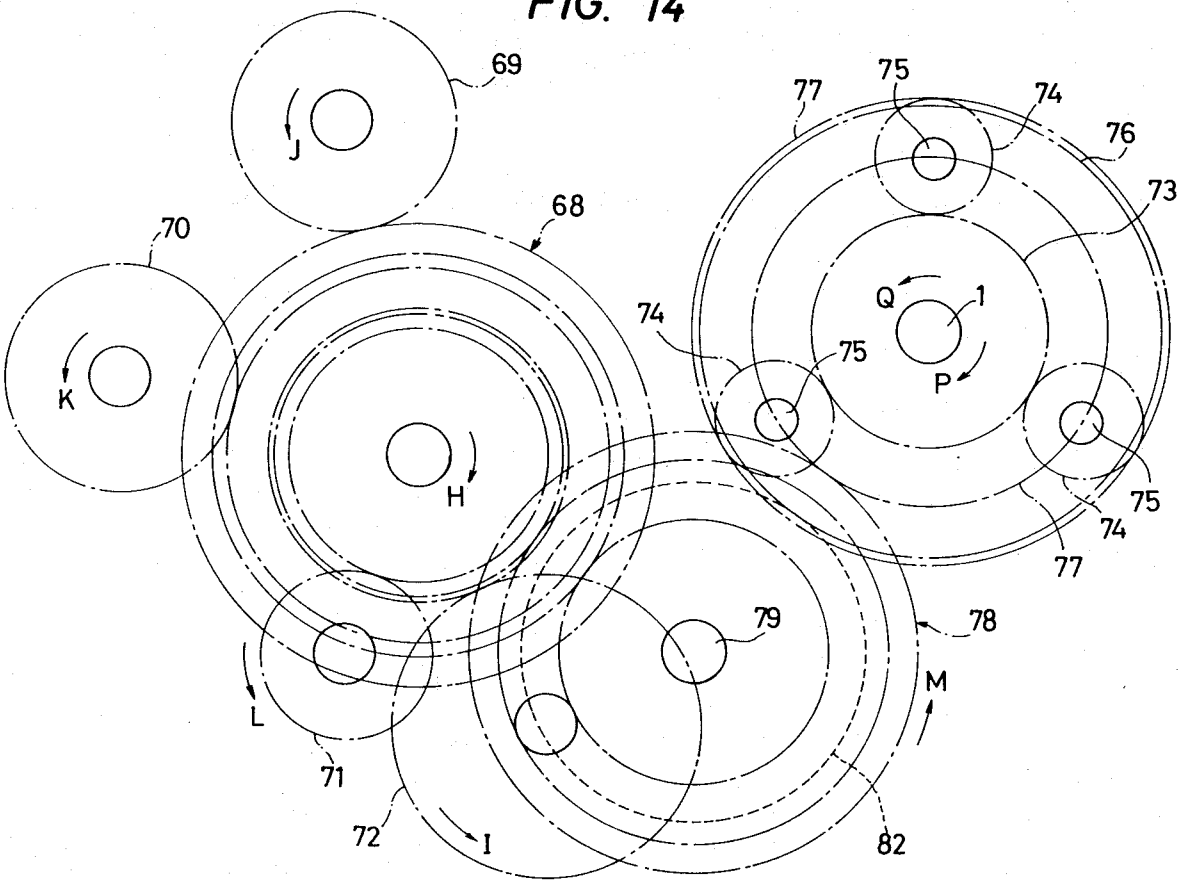
Figure 15A:
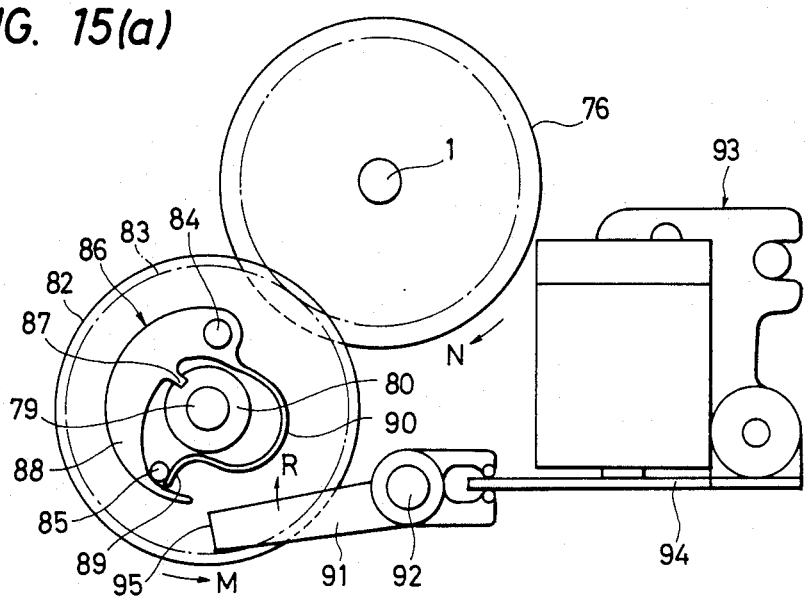
Figure 15B:
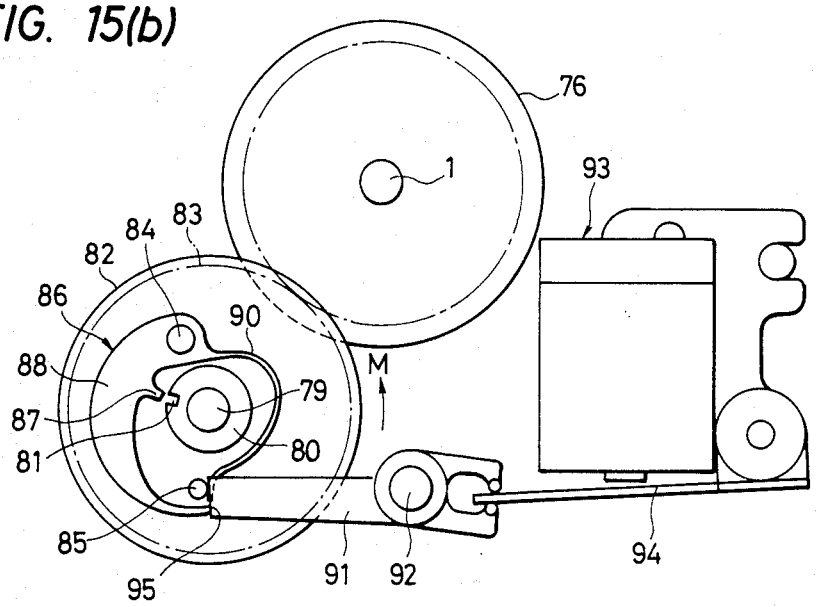
Figure 16:
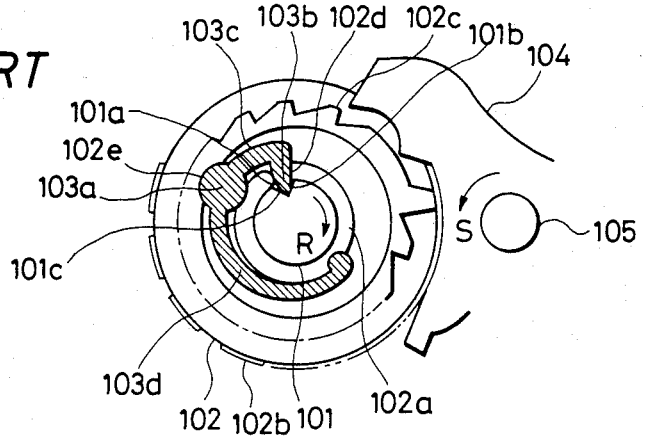
FIG. 16 PRIOR ART
FIG. 16 is a fragmentary view of a prior art printer.
Figure 17A:
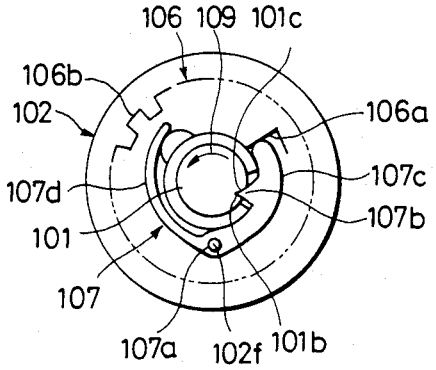
FIG. 17(a) PRIOR ART
FIGS. 17(*a*) and 17(*b*) are fragmentary view of another prior art printer.
Figure 17B:
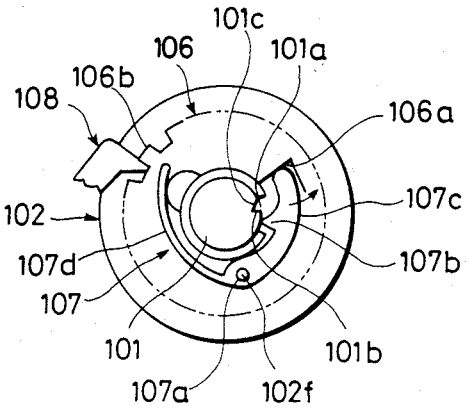
FIG. 17(b) PRIOR ART

FIG. 13 is a timing chart showing relationships between different motions taken during one line printing, FIG. 14 shows a simplified arrangement of the power transmitting system, and FIGS. 15(*a*) and 15(*b*) illustrate a claw clutch mechanism provided in the power transmitting system.

In FIG. 13, the drive shaft 2 rotates one and a half revolution in one direction during one line printing to effect inking in the first half revolution, type selection in a subsequent half revolution and printing and paper feeding in the final half revolution. Since the type selecting operation must locate a desired type 7 or 7' on the printing wheel at a proper printing position, the drive shaft 2 must rotate at a modest speed. On the other hand, the inking operation to compress the ink rolls 59-60 on to the type 7 or 7' and the paper feeding operation to transport a paper sheet do not require such a speed control and rather prefer a faster rotation of the drive shaft 2.

This control of the rotating direction and rotating speed is effected by a power transmission system shown in FIG. 14 where reference numeral 68 designates a drive gear having a plurality of gear teeth. The drive gear 68 is driven by a constant speed motor via an intermediate gear (not shown) in a fixed direction, e.g. in arrow H direction in FIG. 14. Reference numeral 69 denotes a hammer gear which drives the hammer 47, 70 refers to a tape feeding gear which drives the tape feeding roller 50, 71 refers to a reset gear which drives the reset cam, and 72 denotes a rotary shaft gear which drives the rotary shaft 27. The rotary shaft gear 72 always engages the drive gear 68 at a predetermined speed ratio and rotates at a fixed speed in arrow I direction. The hammer gear 69, tape feeding gear 70 and reset gear 71 intermittently or selectively engage the drive gear 68 at respective determined speed ratio to rotate in arrow J, K or L direction only when the drive gear 68 takes an angular position predetermined therefor respectively.

Reference numeral 73 designates a sun gear which is unitary with the rotary shaft 1, 74 refers to three planet gears encircling and engaging the sun gear 73, 75 designates carrier shafts rotatably supporting the planet gears 74-74, 76 denotes a carrier unitary with the carrier shafts 75-75, and 77 refers to a ring gear which engages outer ends of the planet gears 74-74. These sun gear 73, planet gears 74-74, carrier 76 and ring gear 77 form a known planet gear system, using the carrier 76 and ring gear 77 as input shafts and the sun gear 73 as an output shaft. Reference numeral 78 denotes a selection gear interposed between the planet gear system and the drive gear 68 and integrally including three gears which are different in number of gear teeth. The selection gear 78 rotates in arrow M direction or stops at a predetermined timing by intermittent engagement of two gears thereof with the drive gear 68. More specifically, the selection gear 78 rotates at a moderate speed while one of the gears having a larger number of teeth engages the drive gear 68, and rotates at a high speed while another gear having less teeth engages the drive gear 68. Further, the selection gear 78 remains stationary while a teeth-lacking portion thereof engages an arcuate projection of the drive gear 68 (both not shown).

Rotation of the selection gear 78 is transmitted to the ring gear 77 by engagement between the ramainder gear of the selection gear 78 and the ring gear 77, and is further selectively transmitted to the carrier 76 via the claw clutch mechanism shown in FIG. 15.

In FIG. 15, reference numeral 79 refers to a support shaft which rotatably supports the selection gear 78 and a rotary member 82 which will be described later, and 80 refers to a drive shaft concurrently rotatable with the selection gear 78 and having a slit 81 along the outer peripheral surface thereof. The rotary member 82 is loosely supported by the support shaft 79, and has a series of teeth along the circumference thereof for engagement with the carrier 76 of the planet gear system. The rotary member 82 also includes a support pin 84 and an engagement pin 85 vertically extending and spaced from each other by a given distance. Reference numeral 86 denotes a drive claw which transmits rotation of the drive shaft 80, i.e. rotation of the selection gear 78 driven by the motor, to the rotary member 82. The drive claw 86 includes a rigid first arm 88 and a resilient second arm 90. The first arm 88 has a projection 87 engageable with the slit 81 of the drive shaft 80, and the proximal end thereof rotatably engages the support pin 84 of the rotary member 82. The second arm 90 of the drive claw 86 has a slide portion 89 resiliently engaging the engagement pin 85 of the rotary member 82. Reference numeral 91 refers to a selection lever pivotably supported by an axle 92, and 93 denotes a solenoid having an actuator 94 to move the selection lever 91 between an engageable position opposed to the drive claw 86 and a disengagement position out of the orbit of the drive claw 86.

With this arrangement of the claw clutch mechanism, assume now that, as shown in FIG. 15(*a*), the projection 87 of the drive claw 86 engages the slit 81 of the drive shaft 80, the solenoid 93 is energized, and its actuator 94 holds the selection lever 91 at the disengagement position away from the drive claw 86. When the selection rotary shaft 79 and drive shaft 80 rotate in arrow M direction with rotation of the gear 78, the slit 81 engages the projection 87 of the drive claw 86 to establish unitary rotation of the drive shaft 80 and rotary member 82 in arrow M direction. The rotation of the rotary member 82 is transmitted to the carrier 76 engaging the teeth 83 thereof to rotate the carrier 76 in arrow N direction. At this time, since the rotation of the selection gear 78 synchronously rotating with the drive shaft 80 is transmitted to the ring gear 77, planet gear 74 and sun gear 73 as described above, the motor rotation is transmitted via the selection gear 78 and rotary member 82 (both rotating together) to the carrier 76 and ring gear 77 which are two input shafts of the planet gear system. Therefore, the sun gear 73 which is the output of the planet gear system is rotated in arrow P direction of FIG. 14, for example, to concurrently rotate the rotary shaft 1 unitary therewith in the same arrow P direction.

To rotate the rotary shaft 1 in the opposite direction, i.e. in arrow Q direction of FIG. 14, the solenoid 93 is deenergized to allow the selection lever 91 to rotate in arrow R direction in FIG. 15(*a*) with the energy of a spring (not shown) and hold same stationary at the engageable position opposed to the drive claw 86 as shown in FIG. 15(*b*). When the rotary member 82 rotates in arrow M direction together with the drive shaft 80 from this condition, a distal end of the first arm 88 of the drive claw 86 contacts a guide portion 95 at the distal end of the selection lever 91, and a subsequent rotation of the drive shaft 80 causes the guide portion 95 to guide and move the first arm 88 outwardly. That is, the drive claw is expanded, against the resiliency of the second arm 90, and the projection 87 of the first arm 88 disengages from the slit 81 of the drive shaft 80 to interrupt power transmission from the drive shaft 80 to the rotary member 82. Therefore, although the motor rotation is transmitted via the selection gear 78 to the ring gear 77 which is one of two input shafts of the planet gear system, it is not transmitted to the other input shaft, i.e. carrier 76, so that the sun gear 73 and the rotary shaft 1 unitary therewith rotate in arrow Q direction in FIG. 14. The speed ratio between rotations of the rotary shaft 1 in arrow P and Q directions is determined by the ratio in the numbers of teeth, etc. of the planet gear 74 and ring gear 77. The illustrated embodiment employs a teeth number ratio to provide a uniform speed ratio in both opposite rotations.

With this arrangement, the following basic operation is effected by driving the motor.

Inking

As shown in FIG. 1, when the printing wheel 5 is rotated by the drive shaft 2 to a predetermined direction while the projection 21 of the drive claw 20 engages the slit 3 or 4 of the drive shaft 2, the changeover cam 65 (FIG. 10) is rotated integrally with the outermost printing wheel to a predetermined position. With one full rotation of the changeover cam 65, the first ink roll 59 is compressed to the first type array 7 on the printing wheel 5, and the second ink roll 60 is compressed to the second type array 7'. More specifically, for effecting red color printing, for example, red ink of the first ink roll 59 is applied to the first type array 7 on the printing wheel 5 in about a half revolution of the drive shaft 2 in arrow F direction of FIG. 11(*a*). With a subsequent half revolution of the drive shaft 2, type selecting operation is effected in the printing wheel 5 already provided with red ink on the first type array 7 to locate a desired type 7 to the printing position. When the drive shaft 2 is rotated in the opposite direction, black ink of the second ink roll 60 is applied to the second type array 7' on the printing wheel 5 with the first half revolution of the drive shaft 2, and a desired type 7' is located to the printing position with a subsequent half revolution of the drive shaft 2.

Type Selection

After desired ink is applied to the type array 7 or 7' in the first half revolution of the drive shaft 2, a subsequent half revolution of the drive shaft 2 rotates the printing wheel 5 up to a position where a desired type 7 or 7' is opposed to the hammer 47. Such a type selecting operation has been described above, and is not repeated here. It should be noted here that such a type selecting operation is not required in some of the printing wheels. Since the engagement projection 14 of any selection ratchet 6 never fails to engage the claw portion 26 of the selection claw 25 at a given position during one full rotation thereof, any printing wheel from which no type was selected also stops once, loosing power from the drive shaft 2 to the selection ratchet 6 and printing wheel 5. In this case, however, since the engagement between the selection ratchet 6 and selection claw 25 is automatically effected by the engagement projection 14 of the selection ratchet 6 and the claw portion 26 at the distal end of the selection claw 25, energization of the electromagnetic clutch is not required here unlike the type selecting operation, and the power consumption is significantly reduced. Any printing wheel 5 from which no type was selected is stopped at a position shown in FIG. 1 where no type array 7 nor 7' is opposed to the hammer 47.

As will be supposed from the aforegoing description, with clockwise 180° rotation of the drive original position of FIG. 1, black ink of the second ink roll is applied to the type array 7' on the printing wheel 5, and during a subsequent half rotation of the drive shaft 2 from 180 degrees to 360 degrees with respect to the original angular position thereof, the printing wheel having a selected type 7' is stopped at an angular position where the selected type 7' is opposed to the hammer 47. If the printing wheel 5 has no selected type 7', it is stopped on termination of the second half revolution of the drive shaft 2. After inking and type selecting operations are completed in one rotation of the drive shaft 2, the drive shaft stops, and printing operation is effected subsequently.

Printing

All selected types 7 and/or 7' on the printing wheels 5 are opposed to and project toward the hammer 47 through the projecting portions 58 of the slits 57 of the misprint preventive plate 48 (in printing wheels 5 not selected, blank portions other than the type arrays 7-7' are opposed to the projecting portions 58). A sheet of paper (not shown) is transported on the misprint preventive plate 48 along the paper guide 49 in response to rotation of the paper feeding roller 50 and follower roller 51. When the hammer 47 is rotated counterclockwise in FIG. 1, the paper is compressed to the selected types 7-7' by the push portion 52 of the hammer 47, and a single line of numbers or letters is printed on the sheet. The aforementioned resiliency of the push portion 52 of the hammer 47, hardness of the outer surface thereof and separate configuration thereof corresponding to respective printing wheels 5 ensure a clear printing on the paper.

During the printing operation, printing wheels 5-5 remaining stationary at the printing positions receive a rotational force in a given direction upon contacting the pivotally moving hammer 47. However, the illustrated embodiment employs an arrangement best shown in FIG. 5(*b*) and 5(*c*) to prevent any error in the printing positions of the printing wheels 5-5 caused by the rotational force from the hammer 47.

FIG. 5(*b*) shows a configuration where the projection 21 of the drive claw 20 is out of the slit 3 of the drive shaft 2 rotated in arrow A direction, and the printing wheel 5 stops at a position where a selected type thereon is opposed to the hammer 47. The teeth 13 of the selection ratchet 6 engages the claw portion 26 of the selection claw 25, and the engagement pin 11 and support pin 12 of the printing wheel 5 engage the ends of the engagement holes 18-19 of the selection ratchet 6. Therefore, the printing wheel 5 never rotates regardless a rotational force in arrow A direction applied thereto from the hammer 47. More specifically, when rotating directions of the drive shaft 2 and hammer 47 are different, i.e. when the direction of the rotational force applied to the printing wheel 5 from the hammer 47 is uniform to the rotating direction of the drive shaft 2, the printing wheel 5 is prevented from rotation and reliably held at the position by the engagement pin 11 and support pin 12 thereof engaging the engagement holes 18-19 of the selection ratchet 6 immoved by the selection claw 25.

When the drive shaft 2 is driven in the opposite direction, i.e. when the projection 21 of the drive claw 2 is out of the slit 3 of the drive shaft rotating in arrow D direction as shown in FIG. 5(*c*), the claw portion 26 of the selection claw 25 engages the lock notch 8 of the printing wheel, passing through the space between adjacent teeth 13-13 of the selection ratchet 6. Since the selection claw 25 directly holds the printing wheel 5 in this manner, the printing wheel 5 never rotates regardless of a rotational force in arrow A direction opposite to arrow D direction applied thereto from the hammer 47. If the lock notch 8 is not engaged by the selection claw 25 in FIG. 5(*c*), with a rotational force in arrow D direction applied to the printing wheel 5, the engagement pin 11 and support pin 12 thereof engage the engagement holes 18-19 of the selection ratchet 6 so as to prevent rotation of the printing wheel 5. However, if the printing wheel 5 receives a rotational force in arrow A direction, the printing wheel 5 rotates in the same direction by an amount until the engagement pin 11 and support pin 12 of the printing wheel 5 reach the other ends of the engagement holes 18-19 of the selection ratchet 6. Therefore, when the rotating directions of the drive shaft 2 and hammer 47 are uniform, i.e. when the direction of the rotational force applied to the printing wheel 5 from the hammer 47 is different from the rotating direction of the drive shaft 2, the printing wheel 5 is prevented from rotating and held at the printing position by engagement between the lock notch 8 thereof and the selection claw 25.

Resetting

On completion of the printing operation, the drive shaft 2 which was stationary during the printing operation makes another half revolution in the same direction from 360 degrees to 450 degrees with respect to its initial position. Also, all the selection claws 25-25 heretofore engaged by the teeth 13 or engagement projections 14 of the selection ratchets 6 are reset to stand-by positions by the reset cam 29. More specifically, when the reset cam 29 rotates counterclockwise in FIG. 1, the selection claw 25 engaging the teeth 13 of the selection ratchet 6 as best shown in FIG. 6(*b*) rotates in arrow C direction due to its cam claw 30 moved from the small diameter portion 45 to the large diameter portion of the reset cam 29, and the claw portion 26 of the selection claw 25 is disengaged from the teeth 13 of the selection ratchet 6. This operation is concurrently effected in all selection claws 25-25 associated to the printing wheels 5-5, and not only the selection claws having engaged the teeth 13 of the selection ratchets 6 but also the other selection claws having engaged the engagement projections 14 are released from respective engagements so that all the selection claws 25 are held at their stand-by positions by the reset cam 29 and push spring 33. It should be noted that the printing wheels 5 take different angular positions when they stop at their printing positions, depending on positions of types selected therefrom. For example, printing wheels 5 from which no type is selected stop at an angular position rotated by substantially one full rotation from the original position, whereas printing wheels from which any type is selected stops at angular positions less than one full rotation.

When the selection ratchets 6 disengage from the selection claws 25, the printing wheels 5 heretofore held at printing positions as well as the selection ratchets 6 rotate integrally with the drive shaft 2 under resilient contact of the drive claw 21 on the peripheral surface of the drive shaft 2 other than the slits 3-4. Since this resilient engagement simply provides a small power transmission from the drive shaft 2 to the printing wheel 5, when the engagement projection 96 of the printing wheel 5 reaches and engages the claw portion 26 of the selection claw 25 at a stand-by position, the printing wheel 5 and selection ratchet 6 stop there, and a subsequent rotation of the drive shaft 2 allows the projection 21 of the drive claw 20 to slip on the outer peripheral surface of the drive shaft 2. Since the engagement projection 96 on the printing wheel 5 is located outward of the engagement projection 14 of the selection ratchet 6, all the printing wheels 5-5 which have taken different angular positions during the printing operation are reset to a uniform angular position rotated by substantially one full revolution from each original position due to engagement between the engagement projection 96 and selection claw 25.

After the projections 96-96 of all printing wheels 5 engage the selection claws 25-25, the projection 21 of each drive claw 2 engages the slit 3 or 4 of the drive shaft 2 again. In this case, while the drive shaft 2 effects one and a half rotation with respect to its original position, the printing wheel 5, selection ratchet 6 and drive claw 20 effect about a half revolution. Therefore, assuming that the projection 21 of the drive claw 20 initially engages the slit 3 of the drive shaft 2, the projection 21 now engages the other slit 4 of the drive shaft 2 at the reset position. With a subsequent rotation of the drive shaft 2 up to about one and a half revolution from the initial position, the printing wheels 5-5 and selection ratchets 606 rotate integrally with the drive shaft 2 under engagement between the projection 21 of the drive claw 2 and the slit 3 or 4 of the drive shaft 2. Since this configuration provides a large power transmission from the drive shaft 2 to the printing wheels 5-5, the selection claws 25-25 are rotated outwardly against the energy of the push spring 33 by the printing wheels 5 now reliably rotating integrally with the drive shaft 2, and the claw portion 26 of the selection claw 25 moves over the engagement projection 96 to the initial position of FIG. 1 where the drive shaft 2, printing wheel 5 and selection ratchet 6 stop.

Paper Feeding

When the printing operation is finished, the paper feeding roller 50 is rotated counterclockwise in FIG. 1 parallely with the resetting motions, and the paper closely sandwiched between the paper feeding roller 50 and follower roller 51 is moved by a given amount for a subsequent series of inking, type selecting and printing operations for the next line.

As described, one series of inking, type selecting, printing, resetting and paper feeding operations effects one line printing. Further, by selectively rotating the drive shaft 2 in one or the other direction by control of the claw clutch, mechanism of FIG. 15, two-color printing, e.g. black and red printing can be effected as desired.

With the above-described construction of the invention, it is possible to select types of the printing wheels during rotation of the drive shaft in either direction. Also, the drive claw never disengages from the drive shaft despite of a small resilient force, and reliably transmits the rotation of the drive shaft to the printing wheel.

Additionally, since the relative positional relationship between the printing wheel and the selection ratchet pivotably mounted on the printing wheel can be controlled by the control pin provided on one of them and the engagement hole provided in the other of them, the printing wheel is reliably held stationary at a desired position during type selection by latching the selection ratchet.

Further, since the printing wheel from which a type is selected is reliably held stationary by engagement between the lock groove of the printing wheel and the selection claw latchingly engaging the selection ratchet, the printing wheel is reliably maintained at the printing position against any pivoting power applied thereto from the hammer during a printing operation, and it never causes positional errors in printed letters or numbers on the printing paper.

The embodiments of the invention in which an exclusive property or privilege is claimed are defined as follows:

1. A printer comprising:

a drive shaft having axial grooves along the circumferential surface thereof;

printing wheels rotatably mounted on said drive shaft and each having a group of types along the circumferential surface thereof;

a drive claw of each said printing wheel and having a projection engageable with said grooves of said drive shaft;

a selection ratchet pivotably mounted on said printing wheel via said drive claw and having an engagement means engageable with said drive claw and a series of teeth formed along the circumferential margin thereof; and a selection claw engageable with said teeth of said selection ratchet to selectively stop the rotation of said selection ratchet;

said printing wheel being linked to and rotated by said drive shaft when said projection of said drive claw engages said groove of said drive shaft;

said selection claw engaging said teeth of said selection ratchet during type selection to latch same, so that when said engagement means of said selection ratchet engages said drive claw, said projection of said drive claw disengages from said groove of said drive shaft and detaches said printing wheel from said drive shaft.

2. A printer of claim 1 wherein said drive claw includes a rigid first arm and a resilient second arm having a bent portion at the distal end thereof, and said printing wheel has a vertically projecting support pin pivotably supporting the proximal end of said first arm and a vertically projecting engagement pin slidably engaging said bent portion of said second arm.

3. A printer of claim 2 wherein said support pin and engagement pin of said printing wheel are located at substantially opposite positions with respect to the axis of said rotary shaft.

4. A printer comprising:

a drive shaft having axial grooves along the circumferential surface thereof;

printing wheels rotatably mounted on said drive shaft and each having a group of types along the circumferential surface thereof;

a drive claw supported on each said printing wheel and having a projection engageable with said grooves of said drive shaft;

a selection ratchet relatively pivotably mounted on said printing wheel via said drive claw and having an engagement means engageable with said drive claw and a series of teeth formed along the circumferential margin thereof; and a selection means engageable with said teeth of said selection ratchet to selectively stop the rotation thereof;

said printing wheel being linked to and rotated by said drive shaft when said projection of said drive claw engages said groove of said drive shaft;

said selection means engaging said teeth of said selection ratchet during type selection to latch same, so that when said drive claw engages said latched selection ratchet, said projection of said drive claw disengages from said groove of said drive shaft, so as to detach said printing wheel from said drive shaft, and so that a control pin provided on one of said printing wheel and selection ratchet engages an engagement hole provided in the other of said printing wheel and selection ratchet, so as to latchingly maintain said printing wheel at a selected angular position for printing.

5. A printer comprising:

a drive shaft having axial grooves along the circumferential surface thereof;

printing wheels rotatably mounted on said drive shaft and each having a group of types along the circumferential surface thereof;

a drive claw supported on each said printing wheel and having a projection engageable with said grooves of said drive shaft;

a selection ratchet pivotably mounted on said printing wheel via said drive claw and having an engagement means engageable with said drive claw, a plurality of teeth and an engagement projection along the circumferential margin thereof;

a selection claw engageable with said teeth and projection of said selection ratchet to stop the rotation thereof; and a drive means for driving said selection claw;

said selection ratchet being latched during type selection by said selection claw which is driven from its stand-by position into engagement with said teeth, so that when said drive claw engages said engagement portion of said selection ratchet, said projection of said drive claw disengages from said groove of said drive shaft;

said selection claw being located at its stand-by position when no type is selected from said printing wheel, and engaging said engagement projection of said selection ratchet to latch same and disengage said projection of said drive claw from said groove of said drive shaft.

6. A printer comprising:

a drive shaft having axial grooves along the circumferential surface thereof and rotatable in opposite directions;

printing wheels rotatably mounted on said drive shaft and each having a group of types along the circumferential surface thereof and lock notches at an inner circumferential margin thereof;

a drive claw supported on each said printing wheel and having a projection engageable with said grooves of said drive shaft;

a selection ratchet pivotably mounted on said printing wheel via said drive claw and having a pair of engagement portions engageable with said drive claw and a series of teeth along the circumferential margin thereof; and a selection claw engageable with said selection ratchet to selectively stop the rotation thereof;

said selection claw engaging one of said notches of said printing wheel to reliably hold the printing wheel at a selected angular position for printing against a pivotal power applied from a hammer to the surface of a selected type of said printing wheel.

* * * * *